US005283986A

United States Patent [19]

Pozzo

[11] Patent Number: 5,283,986

[45] Date of Patent: Feb. 8, 1994

[54] APPARATUS AND METHOD FOR SHARPENING CONTOUR PROFILE CUTTER BLADES

[76] Inventor: Gianfranco Pozzo, Via Padova 3, 33010 Feletto U., Udine, Italy

[21] Appl. No.: 901,877

[22] Filed: Jun. 22, 1992

[51] Int. Cl.[5] ..... B24B 1/00

[52] U.S. Cl. ..... 51/285; 51/218 R; 51/218 A; 51/221 BS; 269/8; 269/101

[58] Field of Search ..... 51/285, 216 R, 216 P, 51/216 CP, 218 R, 218 A, 220, 221 R, 221 BS, 230, 231, 235, 33 HR, 34 BR; 269/8, 53, 100, DIG. 900, DIG. 909

[56] References Cited

U.S. PATENT DOCUMENTS

| | | | |
|---|---|---|---|
| 2,391 | 12/1841 | Johnson | 51/216 R |
| 10,068 | 10/1853 | Gibbs | 51/216 R |
| 609,301 | 8/1898 | Scull | 51/285 |
| 724,116 | 3/1903 | Maley | 269/900 |
| 2,113,874 | 4/1938 | Chaik | 269/8 |
| 2,471,067 | 5/1949 | Hitchcock | 269/8 |
| 4,787,177 | 11/1988 | Scalia | 51/221 R |

*Primary Examiner*—M. Rachuba

[57] ABSTRACT

An apparatus and method for facilitating the grinding wheel sharpening of contour knife blades having a contoured cutting edge formed along one side thereof includes contour profile knife blades having a passageway formed therethrough, the passageway having an opening into the flat surface of the knife blade and an opening into the mounting surface of the knife blade, the opening into the flat surface being of greater diameter than the opening to the mounting surface. A tool bar having linearly-aligned threaded openings formed therein is provided so that the knife blades may be mounted to the tool bar for grinding wheel sharpening thereof, the knife blades being mounted to the tool bar utilizing screws such that the heads of the screws are intermediate the opening the opening in the flat surface and the opening in the mounting surface sufficiently removed from the grinding wheel so that when the selected portion of the knife blade is ground away for sharpening, the screw head is not contacted by the grinding wheel, thus providing a method and apparatus for sharpening contour knife blades utilizing conventional equipment.

5 Claims, 2 Drawing Sheets

APPARATUS AND METHOD FOR SHARPENING CONTOUR PROFILE CUTTER BLADES

BACKGROUND OF THE INVENTION

When cutting contours in wood for applications in cabinets, door parts, or the like, a special cutting tool consisting of a rotating cutter head having a plurality of contoured blades attached thereto is used. The blade contours define the contours which are ultimately cut into the wood. By utilizing precision contoured blades, cabinet doors and other wood products utilizing contoured molding fit together properly and provide a neat and attractive appearance.

In order to maintain product consistency and precision fits, the contoured blades must be removed periodically and sharpened to preserve the ability of the cutter to provide precision cuts, and it is important that all blades from a single cutting head are sharpened identically.

Typically, the contour knife blades are made from tool steel or carbide. The knives made from tool steel tend to wear quickly, which typically rounds the cutting edge. The preferred known method of sharpening the blades is to grind away a portion of the profile edge, which is the cutting edge that defines the contour shape. This so-called "profile grinding" requires a highly skilled operator and the equipment necessary is costly. This method of sharpening reduces the overall size of the contour which requires changes in the mounting arrangement of the blades in the rotary cutter head. Further, since each knife is sharpened individually and on the profile surface, the resultant sharpened blades are less likely to produce a precision contour cut than new blades, resulting in poorly fitted moldings.

Currently, many cutting blades are being formed of carbide due to its ability to withstand continued use over a longer period of time than tool steel, as well as its enhanced ability to hold an edge. Carbide contour knife blades can be disposable which greatly increases the cost of contour cutting operations while wasting materials. This method does, however, maintain the precision of the contour cut. Other carbide blades are resharpenable, but heretofore have been resharpenable only by profile grinding. Accordingly, there is a need for an apparatus and a method of sharpening carbide blades which maintains a precision contour profile and does not require a highly skilled operator.

SUMMARY OF THE INVENTION

It is accordingly an object of the present invention to provide an apparatus and method for sharpening contour knife blades which alleviates the aforementioned problems. More particularly, the present invention provides an apparatus and method for sharpening contour knife blades by providing a tool bar having threaded openings formed therein and knife blades having passageways formed therethrough wherein the knife blades may be screwed to the tool bar with the screw heads a sufficient distance below the flat surface such that they are never encountered by the grinding wheel.

According to the present invention, an apparatus is provided for facilitating the grinding wheel sharpening of contour profile knife blades such as knife blades used for cutting contours in wood, while mounted to rotary cutters generally in pairs. Such apparatus includes at least two knife blades having a generally flat surface, with a cutting edge formed along one side thereof, a mounting surface, and at least one passageway formed therethrough. The passageway has openings to the flat surface and the mounting surface, the opening to the flat surface being of greater diameter than the opening to the mounting surface, and extending a predetermined distance into the passageway. Further, the present invention includes a blade support arrangement having a plurality of threaded openings formed therein and a screw assembly for attaching the knife blade to the blade support arrangement, the screw assembly having a screw head formed with a diameter that is less than the diameter of the opening to the flat surface and greater than the diameter of the opening to the mounting surface so that when the knife blade is positioned on the blade support arrangement with the knife blade passageway aligned with at least one of the blade support arrangement threaded openings, the knife blade can be secured to the blade support arrangement using the screw assembly, with the screw head intermediate the opening in the flat surface and the opening in the mounting surface, thereby removing the screw head from exposure to the grinding wheel. Preferably, the blade support arrangement includes a generally rectangular tool bar in which the plurality of threaded openings are linearly aligned.

In addition, the present invention provides a method for grinding wheel sharpening of contour profile knife blades. The method includes the step of providing at least one knife blade having a flat surface, a mounting surface, a contour cutting edge, and at least one passageway formed therethrough, the passageway having openings to the flat surface and the mounting surface. The opening to the flat surface is of a greater diameter than the opening to the mounting surface and extends a predetermined distance into the passageway.

The method further includes the steps of providing a tool bar having a plurality of threaded openings formed therein and placing the knife blade on the tool bar with the mounting surface in proximate facing relation with the tool bar and having the passageway in the knife blade aligned with at least one of the openings in the tool bar. The method further includes securing the knife blade to the tool bar using a screw assembly having a screw head formed with a diameter that is less than the diameter of the opening to the flat surface and greater than the diameter of the opening to the mounting surface, so that when the knife blade is secured to the tool bar, the screw head is intermediate the flat surface and the mounting surface thereby removing the screw head from exposure to the grinding wheel.

Further, the method may include attaching the tool bar to a magnetized tool support stand, the tool bar being held in place by the magnetic force applied thereto. According to the method of the present invention, each knife blade is sharpened by grinding away a selected portion of the flat surface thereof using the grinding wheel, the portion selected for removal being intermediate the screw head and the grinding wheel. It is preferred that a plurality of knife blades be secured to the tool bar in a generally linear alignment, the plurality of knife blades being sharpened by a common grinding wheel.

DESCRIPTION OF THE PREFERRED EMBODIMENT

Figures 1, 2:
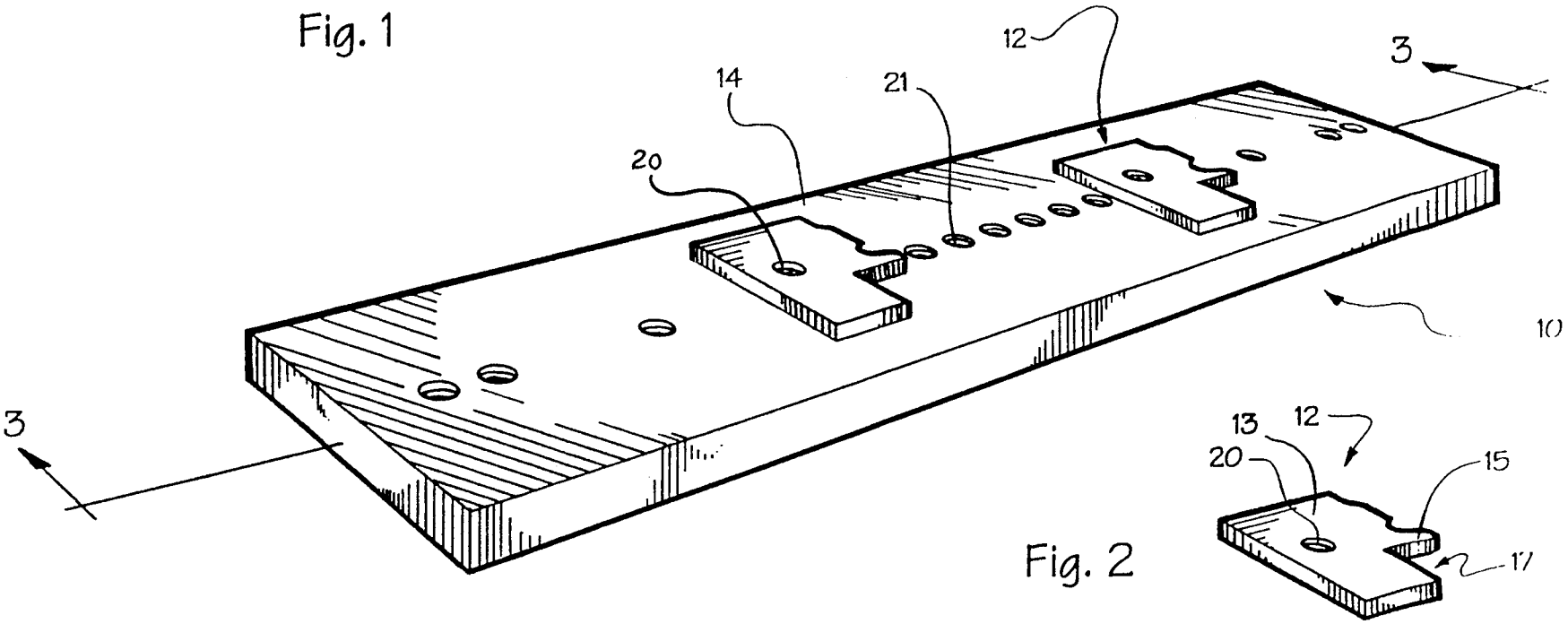
FIG. 1 is a perspective view of a tool bar having contour profile knife blades attached thereto in preparation for sharpening according to the preferred embodiment of the present invention.
FIG. 2 is a perspective view of a contour profile knife blade as illustrated in FIG. 1.

Referring now to the accompanying drawings and initially to FIG. 1, an apparatus for facilitating the grinding wheel sharpening of contour profile knife blades is shown generally at 10 and includes a tool bar 14, and a plurality of contour profile knife blades 12 each having a passageway 20 formed therethrough. As illustrated in FIG. 1, the contour profile knife blades 12 are mounted to the tool bar 14 for sharpening. The tool bar 14 is a generally rectangular slab of tool steel having a plurality of threaded openings 21 formed therein and aligned in a linear fashion.

With reference to FIG. 2, a contour profile knife blade 12 is shown to be generally rectangular in shape having a contoured cutting surface 15 having a cutting edge formed along one side thereof. It is the contour flat surface 15 that defines the general profile of a contoured wood cut provided by the knife blade 12 when attached to a rotary cutting device (not shown). The knife blade 12 includes a flat surface 13 which is exposed to the grinding wheel during sharpening of the blade 12 and intersecting the contoured cutting surface 15 at the cutting edge and the blade 12 further includes a generally planar mounting surface 17 which is in contact with the tool bar 14 when the blade 12 is mounted thereto.

Figure 3:
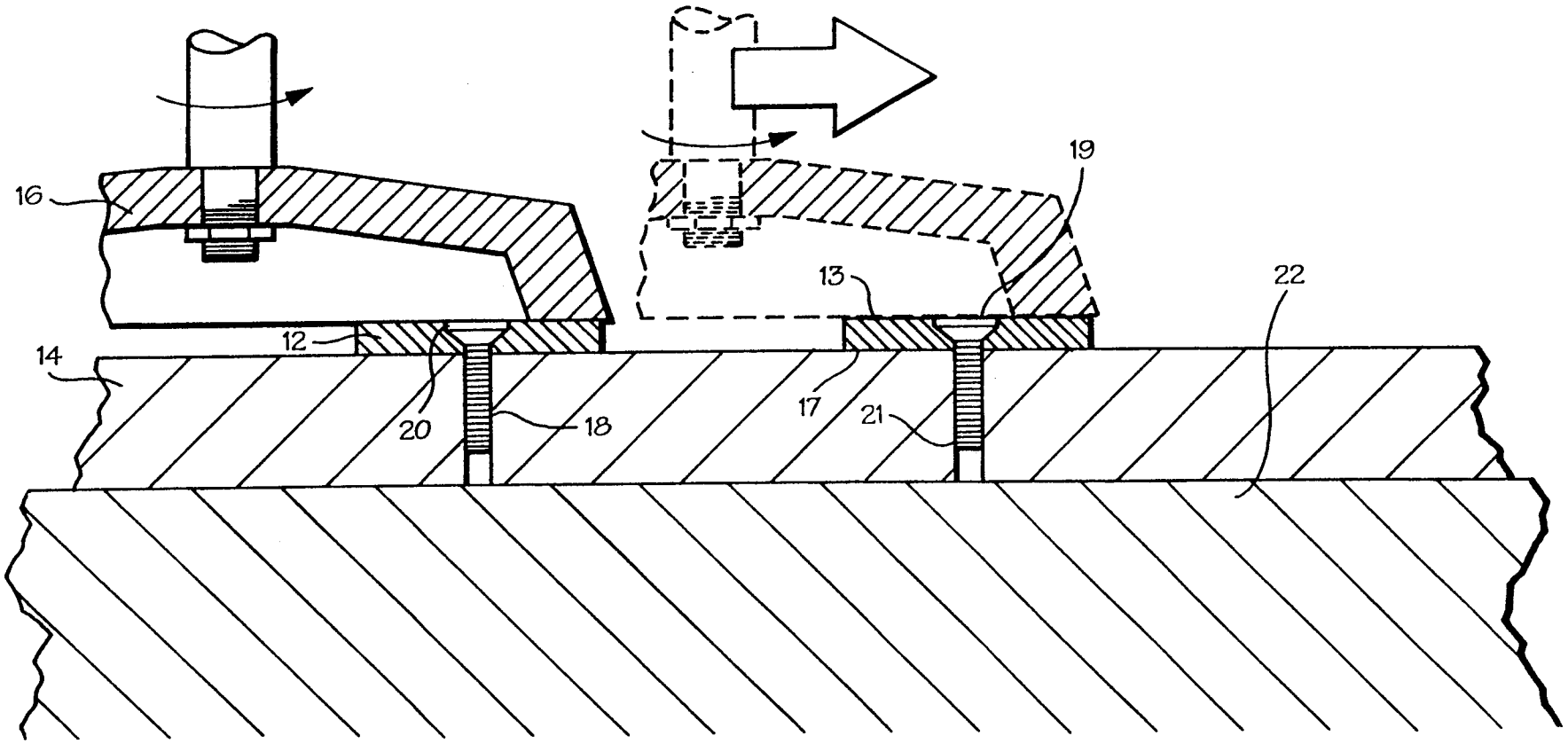
FIG. 3 is a cross-sectional view of the tool bar mounted to a tool holder having the contour profile knife blades mounted thereon for grinding wheel sharpening thereof.

Referring now to FIG. 3, the knife blade passageway 20 is aligned with one of the tool bar openings 21 and accommodates a screw 18 which secures the contour knife blade 12 to the tool bar 14 utilizing the threaded opening 21 in the tool bar 14. The passageway 20 is formed with an opening to the flat surface 13 which is of a larger diameter than the opening to the mounting surface 17 and larger than the head 19 of the screw 18. Accordingly, the screw 18 is inserted in the passageway 20 and threaded into the tool bar 14, the head 19 of the screw 18 passes to a position below the flat surface 13 and can go no farther. Thus, tightening the screw 18 will result in a securely mounted knife blade 12, and will result in the screw head 19 being located at a position intermediate the flat surface 13 and the mounting surface 17 such that when a selected portion of the flat surface is ground away by the grinding wheel 16 the grinding wheel 16 such that the grinding wheel never contacts the screw head 19.

With particular reference to FIG. 3, the contour knife blades 12 which require sharpening are removed from a rotary cutting device (not shown) and positioned on the tool bar 14. With respect to a single knife blade 12, the passageway 20 formed in the knife blade 12 is aligned with the threaded opening 21 formed in the tool bar 14. A screw 18 is inserted in the passageway 20 and threaded into the threaded opening 21 in the tool bar 14 to a position wherein the screw head 19 is intermediate the opening to the flat surface 13 and the opening to the mounting surface 17. The screw 18 is tightened to the point where the knife blade 12 is secured to the tool bar 14.

The tool bar 14 is then placed on a tool holder 22, which may be magnetically attractive and, if so, the attractive magnetic force between the tool holder 22 and the tool bar 14 holds the tool bar 14 in place even under the shearing forces of the operational grinding wheel 16. Otherwise, the tool bar 14 may be bolted or otherwise affixed to the tool holder 22 or it may be clamped in a vise or otherwise secured. The grinding wheel 16 is used to sharpen all knives 12 on the tool bar 14 by moving horizontally across the flat surfaces 13 of the paired knife blades 12 as illustrated in FIG. 3, and the grinding wheel 16 rotates at high speed to grind away a pre-selected portion of the flat surface 13 of the knife blade 12. By virtue of this movement of the grinding wheel 16 across both paired knife blades 12, it will be appreciated that both paired knife blades 12 are ground evenly by the grinding wheel 16. When the grinding wheel sharpening of the knife blades 12 is complete, the tool bar 14 is removed from the magnetic tool holder 22, the screws 18 are withdrawn from the threaded openings 21 in the tool bar 14 and from the passageways 20. The knife blades 12 are then removed from the tool bar 14 and re-inserted in the rotary cutting device for further contoured cutting of wood products.

As can be seen, the apparatus and method of the present invention provides the ability to sharpen contour profile knife blades on conventional sharpening machines without altering the conventional machine or requiring any additional equipment.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In combination, a plurality of contour knife blades and an apparatus for supporting and positioning contour knife blades to facilitate the grinding wheel sharpening thereof, said apparatus comprising:

(a) at least two knife blades having a generally flat cutting surface with a cutting edge formed along one side thereof, a mounting surface and at least one passageway formed therethrough, said passageway having openings in said flat surface and said mounting surface, said opening in said flat surface being of a greater diameter than said opening in said mounting surface, and extending a predetermined distance into said passageway:

(b) blade support means having a plurality of threaded openings formed therein; and (c) screw means for attaching said knife blade to said blade support means, said screw means having a screw head formed with a diameter that is less than said diameter of said opening in said flat surface and formed with a depth that is less than said predetermined distance at which said opening in said flat surface extends into said passageway so that when said knife blade is positioned on said blade support means with said knife blade passageway aligned with at least one of said blade support means threaded openings, said knife blade is secured to said blade support means using said screw means, with said screw head disposed in said opening in said flat surface and positioned beneath said flat surface, thereby removing said screw head from exposure to said grinding wheel.

2. An apparatus for facilitating grinding wheel sharpening of contour profile knife blades according to claim 1 wherein said blade support means comprises a generally rectangular tool bar formed with said plurality of threaded openings linearly aligned.

3. A method for grinding wheel sharpening of contour profile knife blades, said knife blades being supported for sharpening by a tool holder, said method comprising the steps of:

(1) providing at least one knife blade having a generally flat cutting surface with a cutting edge formed along one side thereof, a mounting surface, and at least one passageway formed therethrough, said passageway having openings to said flat surface and said mounting surface, said opening to said flat surface being of a greater diameter than said opening in said mounting surface, and extending a predetermined distance into said passageway;

(2) providing a tool bar formed of a magnetically attractive material and having a plurality of threaded openings formed therein;

(3) placing said knife blade on said tool bar with said mounting surface in proximate facing relation with said tool bar and having said passageway in said knife blade and at least one of said openings in said tool bar therealigned;

(4) securing said knife blade to said tool bar using screw means having a screw head formed with a diameter that is less than said diameter of said opening to said flat surface and greater than said diameter of said opening to said mounting surface, with said screw head being positioned intermediate said flat surface and said mounting surface;

(5) attaching said tool bar to a magnetized tool support stand, said tool bar being held in place by the magnetic force applied thereto; and (6) simultaneously sharpening said knife blade by grinding away a selected portion of said flat surface thereof using said grinding wheel, said selected portion being intermediate said screw head and said grinding wheel so that said screw head is not exposed to said grinding wheel.

4. A method for grinding wheel sharpening of contour profile knife blades, said knife blades being supported for sharpening by a tool holder, said method comprising the steps of:

(1) providing at least one knife blade having a generally flat cutting surface with a cutting edge formed along one side thereof, a mounting surface, and at least one passageway formed therethrough, said passageway having openings to said flat surface and said mounting surface, said opening to said flat surface being of a greater diameter than said opening in said mounting surface, and extending a predetermined distance into said passageway;

(2) providing a tool bar having a plurality of threaded openings formed therein;

(3) placing said knife blade on said tool bar with said mounting surface in proximate facing relation with said tool bar and having said passageway in said knife blade and at least one of said openings in said tool bar therealigned;

(4) securing said knife blade to said tool bar using screw means having a screw head formed with a diameter that is less than said diameter of said opening to said flat surface and greater than said diameter of said opening to said mounting surface, with said screw head being positioned intermediate said flat surface and said mounting surface;

(5) simultaneously sharpening said knife blade by grinding away a selected portion of said flat surface thereof using said grinding wheel, said selected portion being intermediate said screw head and said grinding wheel so that said screw head is not exposed to said grinding wheel.

5. A method for grinding wheel sharpening of contour profile knife blades according to claim 4 wherein a plurality of said knife blades are secured to said tool bar in a generally linear alignment, said plurality of knife blades being sharpened at the same time by a common grinding wheel.

* * * * *